US011772242B1

(12) United States Patent
Andersson

(10) Patent No.: US 11,772,242 B1
(45) Date of Patent: Oct. 3, 2023

(54) TORQUE TRANSMITTING ASSEMBLY FOR A POWER TOOL

(71) Applicant: ATLAS COPCO INDUSTRIAL TECHNIQUE AB, Stockholm (SE)

(72) Inventor: Patrik Andersson, Skogås (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 0 days.

(21) Appl. No.: 18/037,025

(22) PCT Filed: Dec. 16, 2021

(86) PCT No.: PCT/EP2021/086100
§ 371 (c)(1),
(2) Date: May 15, 2023

(87) PCT Pub. No.: WO2022/129282
PCT Pub. Date: Jun. 23, 2022

(30) Foreign Application Priority Data

Dec. 18, 2020 (SE) ..... 2051502-9

(51) Int. Cl.
*B25B 13/48* (2006.01)
*B25B 23/00* (2006.01)
*B25B 21/00* (2006.01)

(52) U.S. Cl.
CPC ..... *B25B 13/481* (2013.01); *B25B 21/002* (2013.01); *B25B 23/0035* (2013.01)

(58) Field of Classification Search
CPC .. B25B 13/481; B25B 21/002; B25B 23/0035
See application file for complete search history.

(56) References Cited

U.S. PATENT DOCUMENTS 4,287,795 A 9/1981 Curtiss
8,448,535 B2 5/2013 Wang
(Continued)

FOREIGN PATENT DOCUMENTS

FR 2736295 A1 1/1997
WO 2020011510 A1 1/2020

OTHER PUBLICATIONS

Atlas Copco Industrial Technique AB, International Patent Application No. PCT/EP2021/086100, International Search Report, dated Mar. 17, 2022.

(Continued)

*Primary Examiner* — David B. Thomas
(74) *Attorney, Agent, or Firm* — Moore & Van Allen PLLC; W. Kevin Ransom

(57) ABSTRACT

A torque transmitting assembly for a power tool comprising an angle head having a first output shaft which is rotational about a rotational axis and arranged to be connected to a power tool motor for transmitting a rotational movement from the motor to the first output shaft; a power tool attachment part having an input shaft connectable to the first output shaft, a second output shaft and a gear arrangement for transmitting rotational movement from the input shaft to the second output shaft; and fixation means for fixation of the attachment part to the angle head. The fixation means comprises first fixation means arranged to prevent axial displacement of the attachment part relative to the angle head; and second fixation means arranged to prevent rotation about the rotational axis of the attachment part relative to the angle head, which second fixation means is separate from the first fixation means.

10 Claims, 3 Drawing Sheets

(56) References Cited

U.S. PATENT DOCUMENTS

| | | | | |
|---|---|---|---|---|
| 2015/0314427 | A1* | 11/2015 | Carlsson | B25B 13/481 81/57.3 |
| 2021/0276163 | A1* | 9/2021 | Eriksson | B25B 21/007 |
| 2021/0316427 | A1* | 10/2021 | Langhorst | B25B 13/481 |

OTHER PUBLICATIONS

Atlas Copco Industrial Technique AB, International Patent Application No. PCT/EP2021/086100, Written Opinion, dated Mar. 17, 2022.

Atlas Copco Industrial Technique AB, International Patent Application No. PCT/EP2021/086100, International Preliminary Report on Patentability, dated Mar. 16, 2023.

* cited by examiner

TORQUE TRANSMITTING ASSEMBLY FOR A POWER TOOL

CROSS-REFERENCE TO RELATED APPLICATIONS

This application is a National Stage Patent Application (filed under 35 § U.S.C. 371) of PCT/EP2021/086100, filed Dec. 16, 2021, of the same title, which, in turn claims priority to Swedish Patent Application No. 2051502-9 filed Dec. 18, 2020, of the same title; the contents of each of which are hereby incorporated by reference.

FIELD OF THE INVENTION

The present disclosure relates generally to the field of power tools and particularly to power tools provided with an angle head and an attachment part forming part of a torque transmitting assembly.

BACKGROUND OF THE INVENTION

Power tools are sometimes provided with a so-called angle head which comprises a gear arrangement which transmits the rotational motion from the power tool's motor to an output shaft which is arranged at an angle, such as 90°, to the motor's axis. Such angle heads are particularly useful e.g. at nut runner power tools.

For some applications the power tools may additionally be provided with an attachment part which has an input shaft connectable to the output shaft of the power tool or the angle head and an output shaft which is off-set to the input shaft and connectable to a tool, such as a bolt or nut engaging tool. Typically, the output shaft of the angle head is provided with a square, polygonal or splined drive and the input shaft of the attachment part exhibits a correspondingly formed recess which receives the drive. An attachment part is also known as a crowfoot, a front part attachment, an offset attachment or an offset gearhead. Below it will be referred to as an attachment part. Such attachment parts are generally used in confined spaces where it is not possible to use an ordinary power tool such as an ordinary nut runner, due to that it is difficult to access the bolt or nut of the joint to be fastened or loosened.

For various applications it is thus advantageous to provide the power tool with a torque transmitting assembly which comprises an angle head, an attachment part and a means for fixation of the attachment part to the angle head. At such torque transmitting assemblies, it is of great importance that the attachment part is prevented from rotating relative to the angle head. Such relative rotation would otherwise severely impair the operation of the power tool. A rotating attachment part also runs the risk of hitting the fingers of the operating person holding the power tool, which may lead to serious injuries.

At such previously known torque transmitting assemblies, the attachment part is normally attached to the angle head by means of a threaded connection. Typically, the angle head is provided with an internally threaded nut or the like which is axially fixed concentrically around the output shaft, such that it may rotate relative to a neck portion of the angle head. The attachment part is provided with a corresponding external thread arranged on a sleeve which is stationary fixed to the attachment part. When attaching the attachment part to the angle head, the sleeve is inserted into the nut and the nut is rotated such that the sleeve is threadedly engaged with the nut. The nut is tightened to a certain torque such that the attachment part is rotationally fixed to the angle head by a corresponding friction engagement. However, when operating the power tool such as for tightening or loosening a bolt, the torque transmitted from the motor via the angle head and the attachment part to the nut engaging tool will, for one operational rotational direction, act opposite to the frictional force between the nut and sleeve. At high operational torques, this may result in that the threaded engagement between the nut and the sleeve is loosened such that the rotational fixation of the attachment part is lost.

For enhancing the rotational fixation of the attachment part, it is common to apply a thread-locking adhesive, such as Loctite® or the like to the threaded engagement between the nut and the sleeve. However, such thread-locking adhesives could fail if the threads are exposed to heavy impacts such as if the power tool is dropped and hits the floor. Additionally, the application of thread-locking adhesives greatly complicates the removal of the attachment part e.g. for allowing service and maintenance and at exchange of the attachment part.

It is also known to enhance the rotational fixation of the attachment part by designing the nut, the sleeve and the threads with comparatively large diameters. By this means, the lever by which the threaded frictional engagement resists the loosening torque caused by the operational torque acting on the tool is increased. However, such increase of especially the nut's diameter increases the overall dimensions of the power tool which importantly impairs the ability to operate the tool in confined spaces.

SUMMARY OF THE INVENTION

One object of this disclosure is therefore to provide an enhanced torque transmitting assembly for a power tool.

Another object is to provide such an assembly at which the attachment part, at operation of the power tool, is securely prevented from unintentionally rotating relative to the angle head.

A further object is to provide such an assembly which allows easy dismounting of the attachment part from the angle head when desired.

Still another object is to provide such an assembly which has comparatively small dimensions and which allows operating the power tool in confined spaces.

Yet another object is to provide such an assembly which is simple in design and which comprises a comparatively low number of constituent components.

A further object is to provide such an assembly which is reliable in use and which has a comparatively long service life.

According to one aspect, these objects are achieved by a torque transmitting assembly for a power tool as set out in appended claim 1. The torque transmitting assembly comprises an angle head having a first output shaft which is rotational about a rotational axis and arranged to be connected to a power tool motor for transmitting a rotational movement from the motor to the first output shaft, a power tool attachment part having an input shaft which is connectable to the first output shaft, a second output shaft and a gear arrangement for transmitting rotational movement from the input shaft to the second output shaft; and fixation means for fixation of the attachment part to the angle head. The fixation means comprises; first fixation means arranged to prevent axial displacement of the attachment part relative to the angle head; and second fixation means arranged to prevent rotation about the rotational axis of the attachment part relative to the angle head, which second fixation means is separate from the first fixation means.

The fixation of the attachment part to the angle head is thus divided into separate means for axial fixation and for rotational fixation respectively. This allows for that the first means may be selected exclusively for accomplishing a secure axial fixation and that the second means may be selected exclusively for accomplishing a secure rotational fixation. In particular, the second fixation means may be selected such that it does not rely on any frictional or threaded engagement which is prone to be loosened when operating the power tool for transmitting operational torque via the angle head and the attachment part. On the other hand, the first fixation means may still comprise e.g. threaded engagement means which entails secure axial fixation while allowing easy dismounting for removal of the attachment part from the angle head.

According to one embodiment, the second fixation means comprises a torque transmitting ring.

The second fixation means may comprise at least two sets of mutually cooperating form-locking members.

The torque transmitting ring may be fixed from rotation relative to the angle head by means of a first set of form-locking members and relative to the attachment part by means of a second set of form-locking members.

Each set of form-locking members may comprise a male member and a female member, which female member is arranged to form-lockingly receive the male member.

The torque transmitting ring may comprises a female member of the first and the second sets of form-locking members.

The first set may comprise a radially protruding male member arranged on the angle head and the second set may comprise a axially protruding male member arranged on the attachment part.

The first fixation means may comprise a rotatable connector which is axially fixed to one of the angle head and the attachment part and which is provided with a first engagement means arranged for rotational engagement with a second engagement means provided on the other of the angel head and the attachment part.

The first engagement means may comprise a first thread and the second engagement means may comprise a second thread, which first and second threads are arranged for mutual threaded engagement.

The rotatable connector may be axially fixed to the angle head.

The first thread may be an internal thread provided on the rotatable connector and the second thread may be an external thread provided on the attachment part.

The torque transmitting ring and the rotatable connector may be axially fixed to the angle head.

The torque transmitting ring and the rotatable connector may be axially fixed to the angle head by means of a threaded support disc which is arranged to support a ball bearing which supports the first output shaft.

The disclosure also relates to a power tool such as a nut runner comprising a torque transmitting assembly as set out above.

Further objects and advantages of the torque transmitting assembly will be apparent from the following detailed description of exemplifying embodiments and from the appended claims.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The term "axially fixed" is used to denote a fixation of one part to another which unables or limits relative axial movement of the parts but which may allow other relative movement such as rotational, radial or lateral movements. Correspondingly the term "rotationally fixed" is used to denote a fixation of one part to another which unables or limits relative rotational movement of the parts but which may allow other relative movements such as axial, radial or lateral movements.

BRIEF DESCRIPTION OF THE DRAWINGS

Aspects and embodiments are now described, by way of example, with reference to the accompanying drawings, in which.

DETAILED DESCRIPTION

Figure 1:
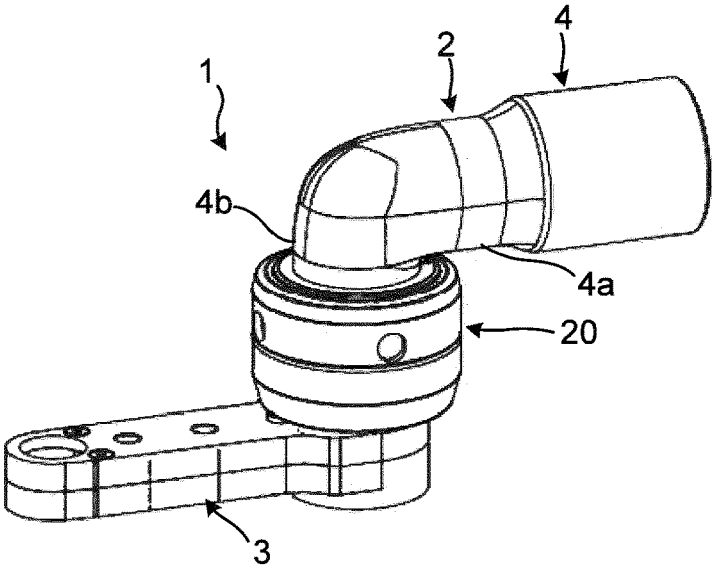
FIG. 1 is a perspective view of a torque transmitting assembly according to one embodiment.
Figure 2:
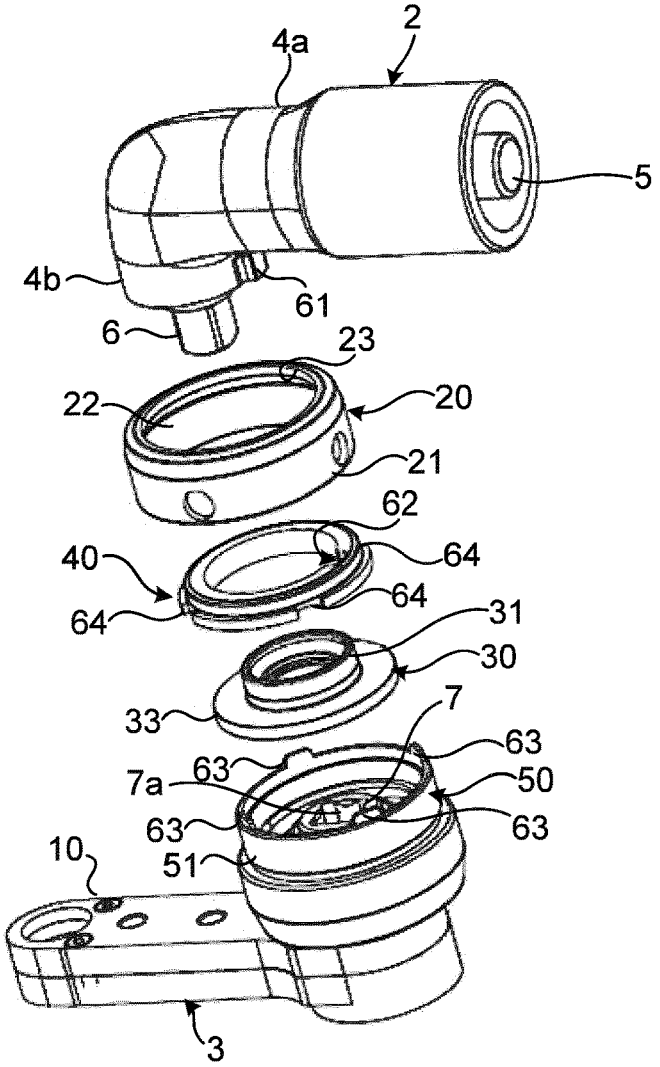
FIG. 2 is an exploded view in perspective of the assembly shown in FIG. 1.
Figure 3A:
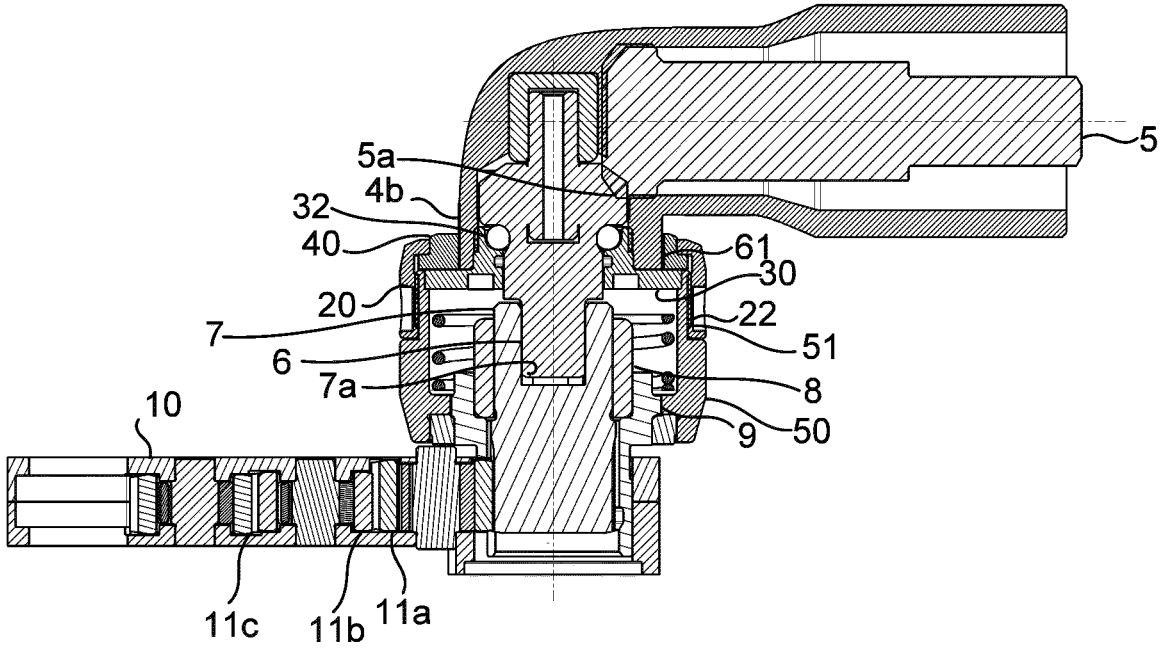
FIGS. 3*a* and 3*b* are sections along different planes of the assembly shown in FIG. 1.
Figure 3B:
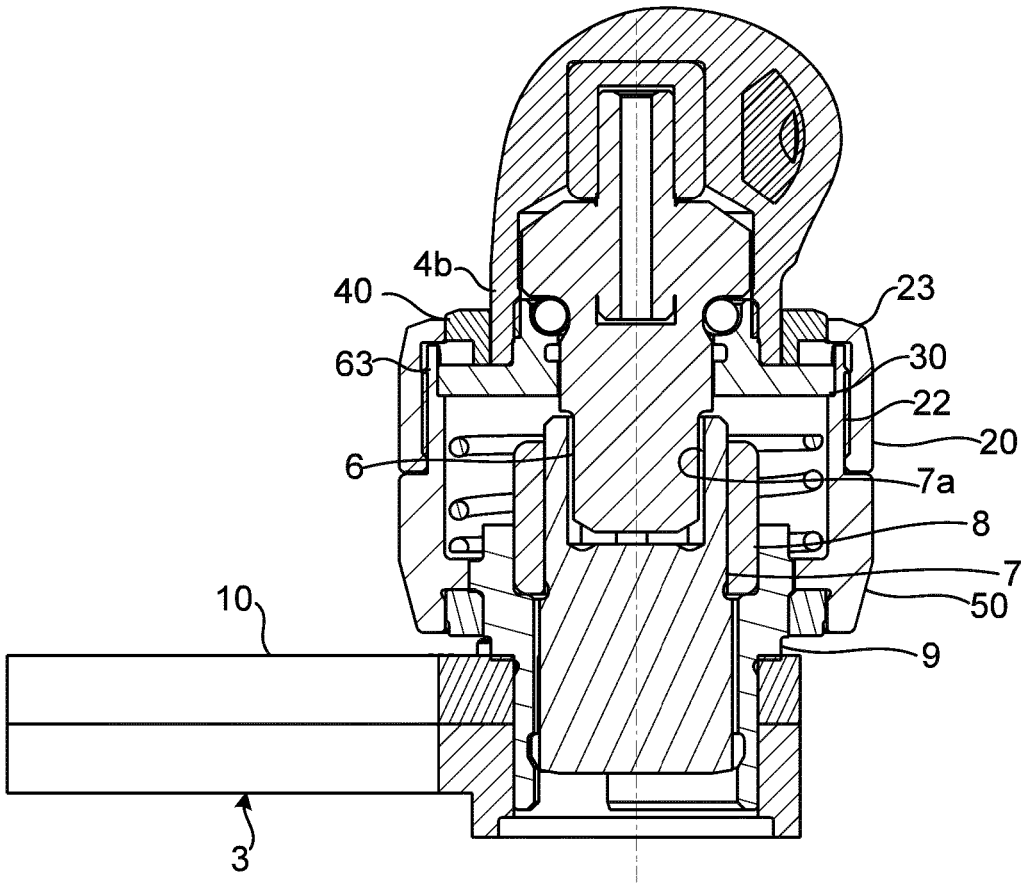

The aspects of the present disclosure will now be described more fully hereinafter with reference to the accompanying drawings, in which certain embodiments of the invention are shown.

These aspects may, however, be embodied in many different forms and should not be construed as limiting; rather, these embodiments are provided by way of example so that this disclosure will be thorough and complete, and to fully convey the scope of all aspects of invention to those skilled in the art. Like numbers refer to like elements throughout the description.

The torque transmitting assembly 1 shown in FIGS. 1, 2, 3*a* and 3*b* comprises an angle head 2, an attachment part 3 and fixation means for fixation of the attachment part 3 to the angle head 2.

The angle head 2 is arranged to be attached to a power tool drive unit (not shown) in a manner which is well known to the skilled person. It comprises housing 4 with a first portion 4*a* extending in a first direction and a generally cylindrical neck portion 4*b* which extends axially essentially perpendicular to the first direction. The first portion 4*a* receives a drive shaft 5 which is arranged to be connected to the rotational shaft of a motor (not shown), such as an electric, hydraulic or pneumatic motor, arranged in the drive unit. The angle head further comprises a first output shaft 6 which is connected to the drive shaft 5 by means of a bevel gear arrangement 5*a* received in the housing 4. The first output shaft 6 comprises in the shown example a square drive which protrudes axially from a free open end och the neck portion 4*b*. At alternative not shown embodiments, the first output shaft may have other non-cylindrical cross-sections such as hexagonal or splined cross-section.

The attachment part 3 comprises an input shaft 7 with a recess 7*a* which faces the first output shaft 6 and which has a cross-section corresponding to the cross-section of the output shaft 6 such that the first output shaft may be form-lockingly received in the recess 7*a*. The input shaft 7 is radially supported by bearings 8 in a generally cylindrical housing 9 of the attachment part 3 (see FIGS. 3*a* and 3*b*). The attachment part 3 further comprises an extension 10 which protrudes radially from the lower portion of the housing 9 and which receives a number mutually meshing intermediate gears 11*a*, 11*b*, 11*c*, one 11 a of which meshes with gear teeth (not shown) arranged on the input shaft 7. The outmost intermediate gear 11*c* meshes with an output gear (not shown) which is fixed to a second output shaft (not shown). The output shaft is provided with a tool connecting interface (not shown) which is arranged to engage a tool for tightening and loosening a bolt, a nut or the like in a manner which is known in the art.

When the attachment part 3 is fixed to the angle head 2 and the power tool is operated, the rotation of the motor shaft (not shown) is transmitted to the second output shaft (not shown) via the drive shaft 5, the bevel gear arrangement 5*a*, the first output shaft 6, the input shaft 7 and the intermediate gears 11-*c*.

The fixation means for fixation of the attachment part 3 to the angle head 2 comprises first fixation means and second fixation means. The first fixation means is arranged to prevent the attachment part 3 to be moved axially relative to the angle head 2. The first fixation means comprises an annular rotatable connector 20 which receives the neck portion 4*b*. The rotatable connector 20 comprises a cylindrical portion 21 with a first internal thread 22 and an annular flange 23 which protrudes radially inwards from the upper edge of the cylindrical portion 21. The rotatable connector 20 is axially fixed to the angle head 2 by means of a support disc 30 which comprises an externally threaded cylindrical sleeve portion 31 which is threadedly received in the neck portion 4*b* of the angle head 2. The upper edge of the sleeve portion 31 forms an annular seat for bearing balls 32 which supports the first output shaft 6 inside the neck portion 4*b*. The support disc 30 also comprises an annular disc portion 33 which protrudes radially outwards from the lower edge of the sleeve portion 31.

An annular torque transmitting ring 40 is arranged between the annular connector 20 and the support disc 30 such that it is clamped between the annular flange 23 and the annular disc portion 33.

By this means the annular connector 20 is axially fixed to the neck portion of the angle head 2 such that it may be rotated around but not removed axially from the neck portion 4*b* also when the attachment part is disconnected from the angle head 2.

The first fixation means further comprises an external thread 51 which is arranged on a cylindrical sleeve member 50 which is fixed to the housing 9 of the attachment part 3. At this embodiment, the sleeve member 51 and the housing 9 are interconnected by means of a spline arrangement (not shown). The spline arrangement allows for a so-called indexing of the attachment part. The sleeve member 50 comprises, at its lower portion, internal splines which meshes with external splines on the housing 9. At a first relative axial positioning when the splines are meshing the housing is rotationally fixed relative to the sleeve member. This relative axial position is shown in the drawings. However, by axially displacing the housing 9 and the radial extension 10 relative to the sleeve member 50, the splines are brought out of engagement such that the housing 9 and the extension 10 may be rotated relative to the sleeve member 50. Thereafter, the housing may be axially repositioned to the first axial position such that the splines are again brought into engagement and the housing 9 and the extension 10 are rotationally immobilized relative to the sleeve member. Such angular adjustment, called indexing, of the extension relative to the sleeve member and thereby relative to the angle head and the drive unit may be very useful for accessing the bolt or nut to be tightened or loosened in confined spaces. It should however be noted that the fixation means comprising separate first and second fixation means as described herein may be applied to torque transmitting assemblies both with and without such indexing functionality.

For axial fixation of the attachment part 3 to the angle head, the cylindrical sleeve member 50 is inserted in the annular connector 20 and the connector is rotated such that the internal thread 22 on the connector engages the external thread 51 on the sleeve member 50 of the attachment part 3. The rotation of the connector 20 is continued until the upper edge of the housing 9 makes contact with and is pressed to bear against the lower surface of the support disc. When the connector 20 has been threadedly secured to the sleeve member 50, the axial contact between the annular flange 23 of the connector 20 and the torque transmitting ring 40 which is axially supported by the disc portion 33 of the support disc 30, prevents axial movement of the attachment part 3 away from the angle head 3. Simultaneously the axial contact between the upper edge of the attachments part's 3 housing 9 against the lower surface of the support disc 30 prevents axial movement of the attachment part 3 towards the angle head 2. By this arrangement of the first fixation means, the attachment part 3 is axially immobilized relative to the angle head 2.

The second fixation means, for rotational fixation of the attachment part 3 relative to the angle head 2, comprises a first set of mutually cooperating form-locking members and a second set of mutually form-locking members. At the embodiment shown in FIGS. 1-3*b*, the first set comprises a first male member 61 formed as a dog radially protruding outwards from the neck portion 4*b* and a first female member 62 formed as a radial recess in the inner surface of the torque transmitting ring 40. The second set of form-locking members comprises a plurality of second male members 63 formed as tabs projecting upwardly from the upper edge of the attachments part's 3 cylindrical sleeve 50 and a corresponding number of second female members 64, formed as radial recesses in an outwardly protruding radial flange of the torque transmitting ring 40.

When the connector 20 has been threadedly engaged with the cylindrical sleeve 50 of the attachment part 3 as described above, the first male member 61 form-lockingly engages the first female recess 62 of the torque transmitting ring 30. Thereby, the torque transmitting ring 30 is rotationally immobilized relative to the neck portion 4*a* and the entire angle head 2. Simultaneously, each of the second male members 63 of attachments part's 3 cylindrical sleeve 50 engages a respective second female member 64 of the torque transmitting ring. This results in that the cylindrical sleeve 50 and thereby the entire attachment part 3 is rotationally immobilized relative to the torque transmitting ring 40. The combined form-locking effect of the second fixation means' first and second sets of form-locking members (61, 62, 63, 64) is thus that the attachment part 3 is rendered rotationally immobilized relative to the angle head 2.

The separate first and second fixation means thus provides a secure axial and rotational fixation of the attachment part 3 which prevents unintentional loosening caused by the torque transmitted from the angle head to the attachment part. Simultaneously the fixation means allows for easy intentional disassembly and removal of the attachment part simply by unscrewing the annular connector 20 from the attachment part's 3 cylindrical sleeve 50. The form-locking rotational fixation also provides for that the diameters of the neck portion 4*b*, the annular connector 20, the torque transmitting ring 40 and the attachment part's 3 cylindrical sleeve 50 may be kept small such that the manoeuvrability and accessibility in confined spaces are increased.

At the embodiment shown in FIGS. 1-3*b*, the first male member 61 is arranged such that it protrudes from the neck portion 4*b* in parallel with and under the first portion 4*a* of the angel heads 2 housing 4. By this means, the protruding first male member 61 does increase the overall dimensions of the assembly in a manner which reduces the accessibility in confined spaces.

Figure 4:
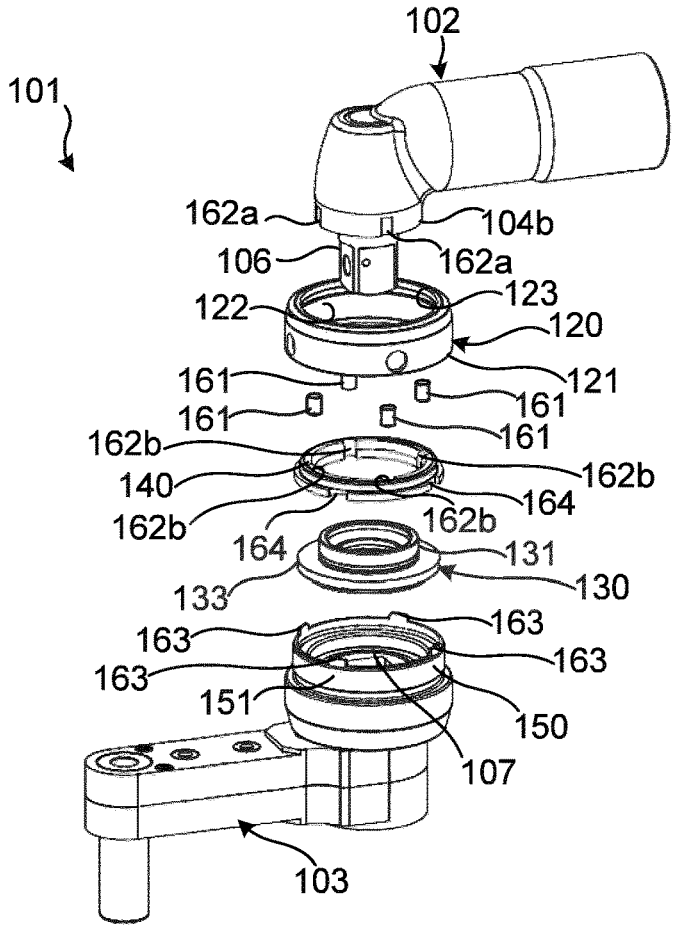
FIG. 4 is an exploded view in perspective of a torque transmitting assembly according to another embodiment.
Figure 5:
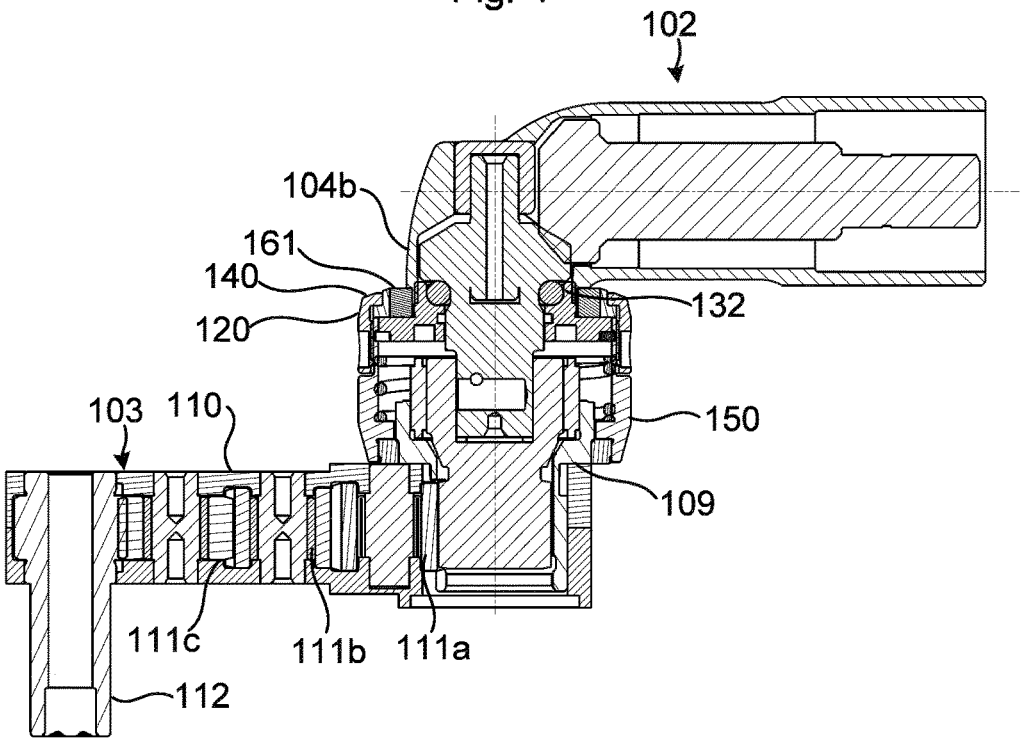
FIG. 5 is a section through the assembly shown in FIG. 4.

FIGS. 4 and 5 illustrate a second embodiment of the torque transmitting assembly 101. An angle head 102 comprises a first output shaft 106 and an attachment part 103 comprises an input shaft 107 which receives the first output shaft 106. The attachment part further comprises a housing 109 and a cylindrical sleeve 150 fixed thereto as well as a gear arrangement 111*a*, 111*b*, 111*c* which transmits rotation of the input shaft 107 to a second output shaft 112, The angel head 102 and the attachment part 103 fully corresponds to the angle head 2 and the attachment part 3 described above and their detailed description is not repeated here.

Also the first fixation means fully corresponds to the first fixation means shown in FIGS. 1-3*b* and comprises an rotatable annular connector 120 with an internal thread 122 arranged on an lower cylindrical portion 121. An annular flange 123 protrudes radially inwards from the upper edge of the cylindrical portion 121. The rotatable connector 20 is axially fixed to the angle head 102 by means of a bearing ball support disc 130 which comprises an externally threaded cylindrical sleeve portion 131 which is threadedly received in the neck portion 104*b* of the angle head 102. The support disc 130 also comprises an annular disc portion 133 which protrudes radially outwards from the lower edge of the sleeve portion 131.

An annular torque transmitting ring 140 is arranged between the annular connector 120 and the support disc 130 such that it is clamped between the annular flange 123 and the annular disc portion 133.

The second fixation means comprises a first set of mutually cooperating form-locking members and a second set of mutually form-locking members. At the embodiment shown in FIGS. 4 and 5, the first set comprises a plurality of pairs of first female members 162*a*, 162*b*. Each pair of first female members comprises a primary female member 162*a* formed as a semi-cylindrical recess arranged in the outer periphery of the neck portion 104*b* and a secondary female member 162*b* formed as a radial recess in the inner surface of the torque transmitting ring 40. The primary female members 162*a* are evenly distributed around the circumferential periphery of the neck portion 104*b* and the secondary female members 162*b* are correspondingly distributed along the inner surface of the torque transmitting ring 140. The first set of form-locking members further comprises a number of first male members 161, which number is equal to the number of pairs of female members 162*a*, 162*b*. In the shown embodiment, the first male members 161 are formed as cylindrical studs. The first set of form-locking members is further arranged such that a male member 162 is received by a primary 162*a* and a secondary 162*b* female member in each pair of first female members such that this form-locking engagement prevents relative rotation between the torque transmitting ring 140 and the neck portion 104*b*.

The second set of form-locking members comprises, just as in the previously described embodiment, a plurality of second male members 163 formed as tabs projecting upwardly from the upper edge of the attachments part's 103 cylindrical sleeve 150 and a corresponding number of second female members 164, formed as radial recesses in an outwardly protruding radial flange of the torque transmitting ring 140.

When the connector 120 has been threadedly engaged with the cylindrical sleeve 150 of the attachment part 103, the first male members 161 form-lockingly engages the primary 162*a* and the secondary 162*b* female member in each pair of first female members. Thereby, the torque transmitting ring 140 is rotationally immobilized relative to the neck portion 104*a* and the entire angle head 102. Simultaneously, each of the second male members 163 of the attachments part's 3 cylindrical sleeve 150 engages a respective second female member 164 of the torque transmitting ring 140. This results in that the cylindrical sleeve 150 and thereby the entire attachment part 102 is rotationally immobilized relative to the torque transmitting ring 40. The combined form-locking effect of the second fixation means' first and second sets of form-locking members (161, 162*a*, 162*b*, 163, 164) is thus that the attachment part 103 is rendered rotationally immobilized relative to the angle head 102.

The separate first and second fixation means provides, just as at the embodiment shown in FIGS. 1-3*b*, a secure axial and rotational fixation of the attachment part 103 which prevents unintentional loosening caused by the torque transmitted from the angle head to the attachment part. Simultaneously the fixation means allows for easy intentional disassembly and removal of the attachment part simply by unscrewing the annular connector 120 from the attachment part's 103 cylindrical sleeve 150. The form-locking rotational fixation also provides for that the diameters of the neck portion 104*b*, the annular connector 120, the torque transmitting ring 140 and the attachment part's 103 cylindrical sleeve 150 may be kept small such that the manoeuvrability and accessibility in confined spaces are increased.

The aspects of the present disclosure have mainly been described above with reference to a few embodiments and examples thereof. However, as is readily appreciated by a person skilled in the art, other embodiments than the ones disclosed above are equally possible within the scope of the invention, as defined by the appended patent claims. For example, the male and female members could have many other forms and geometries than the ones shown and described above as long as they are capable of providing a form-locking functionality. The disclosed fixation means comprising separate first and second fixation means may be applied to torque transmitting assemblies whether or not they are provided with means for allowing angular adjustment, so-called indexing, of the attachment part. The extension and gear arrangement of the attachment part may, depending on the application, take may other forms and have other configurations that the ones shown and described above.

The invention claimed is:

1. A torque transmitting assembly for a power tool, which assembly comprises:

an angle head having a first output shaft which is rotational about a rotational axis and arranged to be connected to a power tool motor for transmitting a rotational movement from the motor to the first output shaft;

a power tool attachment part having an input shaft which is connectable to the first output shaft, a second output shaft and a gear arrangement for transmitting rotational movement from the input shaft to the second output shaft; and fixation means for fixation of the attachment part to the angle head, which fixation means comprises:

first fixation means arranged to prevent axial displacement of the attachment part relative to the angle head; and second fixation means arranged to prevent rotation about the rotational axis of the attachment part relative to the angle head, which second fixation means is separate from the first fixation means, wherein the second fixation means comprises a torque transmitting ring, wherein the second fixation means comprises at least two sets of mutually cooperating form-locking members, wherein said torque transmitting ring is fixed from rotation relative to the angle head by means of a first set of form-locking members and relative to said attachment part by means of a second set of form-locking members, wherein each set of form-locking members comprises a male member and a at least one female member, which female member is arranged to form-lockingly receive the male member, and wherein the torque transmitting ring comprises a female member of the first and the second sets of form-locking members.

2. A torque transmitting assembly according to claim 1, wherein the first set of form-locking members comprises a radially protruding male member arranged on the angle head and the second set of form-locking members comprises an axially protruding male member arranged on the attachment part.

3. A torque transmitting assembly according to claim 1, wherein the first fixation means comprises a rotatable connector which is axially fixed to one of the angle head and the attachment part and which is provided with a first engagement means arranged for rotational engagement with a second engagement means provided on the other of the angel head and the attachment part.

4. A torque transmitting assembly according to claim 3, wherein the first engagement means comprises a first thread and the second engagement means comprises a second thread, which first and second threads are arranged for mutual threaded engagement.

5. A torque transmitting assembly according to claim 4, wherein the first thread is an internal thread provided on the rotatable connector and the second thread is an external thread provided on the attachment part.

6. A torque transmitting assembly according to claim 3, wherein the rotatable connector is axially fixed to the angle head.

7. A torque transmitting assembly according to claim 3, wherein the torque transmitting ring and the rotatable connector are axially fixed to the angle head.

8. A torque transmitting assembly according to claim 7, wherein the torque transmitting ring and the rotatable connector are axially fixed to the angle head by means of a threaded support disc which is arranged to support a ball bearing which supports the first output shaft.

9. Power tool comprising a torque transmitting assembly, said torque transmitting assembly comprising:

an angle head having a first output shaft which is rotational about a rotational axis and arranged to be connected to a power tool motor for transmitting a rotational movement from the motor to the first output shaft;

a power tool attachment part having an input shaft which is connectable to the first output shaft, a second output shaft and a gear arrangement for transmitting rotational movement from the input shaft to the second output shaft; and fixation means for fixation of the attachment part to the angle head, which fixation means comprises:

first fixation means arranged to prevent axial displacement of the attachment part relative to the angle head; and second fixation means arranged to prevent rotation about the rotational axis of the attachment part relative to the angle head, which second fixation means is separate from the first fixation means, wherein the second fixation means comprises a torque transmitting ring, wherein the second fixation means comprises at least two sets of mutually cooperating form-locking members, wherein said torque transmitting ring is fixed from rotation relative to the angle head by means of a first set of form-locking members and relative to said attachment part by means of a second set of form-locking members, wherein each set of form-locking members comprises a male member and a at least one female member, which female member is arranged to form-lockingly receive the male member, and wherein the torque transmitting ring comprises a female member of the first and the second sets of form-locking members.

10. Nut runner comprising a torque transmitting assembly, said torque transmitting assembly comprising:

comprises:

an angle head having a first output shaft which is rotational about a rotational axis and arranged to be connected to a power tool motor for transmitting a rotational movement from the motor to the first output shaft;

a power tool attachment part having an input shaft which is connectable to the first output shaft, a second output shaft and a gear arrangement for transmitting rotational movement from the input shaft to the second output shaft; and fixation means for fixation of the attachment part to the angle head, which fixation means comprises:

first fixation means arranged to prevent axial displacement of the attachment part relative to the angle head; and second fixation means arranged to prevent rotation about the rotational axis of the attachment part relative to the angle head, which second fixation means is separate from the first fixation means, wherein the second fixation means comprises a torque transmitting ring, wherein the second fixation means comprises at least two sets of mutually cooperating form-locking members, wherein said torque transmitting ring is fixed from rotation relative to the angle head by means of a first set of form-locking members and relative to said attachment part by means of a second set of form-locking members, wherein each set of form-locking members comprises a male member and a at least one female member, which female member is arranged to form-lockingly receive the male member, and wherein the torque transmitting ring comprises a female member of the first and the second sets of form-locking members.

* * * * *